US005161749A

United States Patent [19]

Badiali et al.

[11] Patent Number: 5,161,749

[45] Date of Patent: Nov. 10, 1992

[54] DEVICE FOR CORRECTING THE VARIATION IN TENSION OF THE THREAD AS IT UNWINDS IN A SPOOLER

[75] Inventors: Roberto Badiali, Pordenone; Amedeo Quaia, Porcia, both of Italy

[73] Assignee: Savio S.p.A., Pordenone, Italy

[21] Appl. No.: 748,274

[22] Filed: Aug. 21, 1991

[30] Foreign Application Priority Data

Aug. 29, 1990 [IT] Italy ..... 21324 A/90

[51] Int. Cl.[5] ..... B65H 49/02; B65H 54/00

[52] U.S. Cl. ..... 242/128; 242/18 R

[58] Field of Search ..... 242/128, 35.5 R, 35.5 A, 242/35.6 R, 18 R, 54 R; 57/352, 354, 355, 356, 357

[56] References Cited

U.S. PATENT DOCUMENTS 2,944,491 8/1961 Weber ..... 242/128
3,011,736 12/1961 Fuerst ..... 242/128
4,673,138 6/1987 Ichiba ..... 242/35.5 R

FOREIGN PATENT DOCUMENTS 0225670 6/1987 European Pat. Off. .
61-178373 8/1986 Japan .
0839368 6/1960 United Kingdom .

*Primary Examiner*—Stanley N. Gilreath
*Attorney, Agent, or Firm*—George P. Hoare, Jr.

[57] ABSTRACT

The present invention relates to a device for correcting the variation in tension of the thread as it unwinds in a spooler, which is designed to wind thread at high speed. The device comprises two elements which act as unwinding accelerators, one fixedly located above the top of the cop. The moveable element pivots between an inoperative position spaced apart from the cop and an operative position coaxial and surrounding the cop so as to place itself concentrically to the cop and in a lower position at the moment when there is a reduced minimum quantity of wound thread on the end part of the cop being gradually unwound.

6 Claims, 2 Drawing Sheets

21
4
2
8
1
11
7
23
5b
6b
15
9
19
24
16
3
18
22
20
5a
6a

DEVICE FOR CORRECTING THE VARIATION IN TENSION OF THE THREAD AS IT UNWINDS IN A SPOOLER

The present invention relates to a device for correcting the variation in the unwinding tension of the thread in a spooler, which is designed to wind thread at high speed unwinding it from a cop below and collecting it on a reel above being formed.

Some textile working stages involve firstly transferring the thread, at the maximum speed possible, from one package to another. For example, a thread produced in a spinning machine, particularly in a continuous ring frame, is normally wound onto a spool or reel. The thread is then transported and supplied as a spinning cop for a rewinding stage. Spooling involves transferring (rewinding) from the starting cop to the collecting reel, with unravel unwinding, i.e. with axial extraction of the thread from the stationary cop. The starting package is often a co from a ring spinner. Due to the mechanical limitations of a continuous ring frame, the spinning cops have a relatively small quantity of thread, up to a few hundred grams at most. Consequently, they are rewound and wound onto reels on which the quantity of thread and shape are suitable for use in a subsequent operation. Incidentally, the thread from several cops is collected in succession on a single reel. The purpose is always to obtain packages which are more suitable for the subsequent working stages such as dyeing, warping, inserting the weft, etc.

During these transfer operations, the thread may be improved by removing sections with defects of various types. With the continuous increase in the speed of such operations (the length of thread transferred in one unit of time) to reduce production costs, ever greater tension values in the thread are created and, therefore, more frequent breakages occur, which cause a considerable fall in the operating performance of the spooler and its productivity. Incidentally, breakage of the thread occurs under a tension which is greater than the thread's tensile stress.

The thread on each spinning cop, which has been supplied at a set position of a spooler, is drawn upwards with a tension value which gradually increases between the beginning and end of the spinning cop being unwound, as is well known to the textile dressers. Indeed, when the layer of thread on each spinning cop decreases as the winding operation of the spooler progresses, the layer of thread thus diminished twists only round the bottom end of the cop and the thread drawn out of it, travels upwards twisting back round the surface of the cop. In this case, the angle of separation of the layer of thread decreases and thereforefore tension is applied to the travelling thread due to the friction between the lengths of thread, or the contact of the thread with the cop and this may lead to breakage of the thread. This phenomenon occurs more readily in spoolers with a high winding speed. In the more modern spoolers thread transfer speeds of 20–30 m/s are reached.

Furthermore, since the tension at the start of unwinding thread from a single spinning cop is low, the thread is wound onto the reel at a low tension and thus the layer of thread would at low tension may be expanded outwards at one end of the reel due to the pressure of the layer of thread on top of it. Since usually to obtain one reel several spinning cops are used, the expanded part appears within each set period thus causing the formation of a reel with faulty winding which may give rise to unacceptable production for subsequent working stages.

In such an operating process a device is required which adjusts the winding tension of the thread between the start and finish of the cop thus reducing the unwinding tension at the end of the supply cop. Elements are known in the state of the art which by acting on the path of the thread in a fixed position guide it in precise unwinding forms which make it possible to limit the maximum tension values at which breakages of the thread being wound frequently occur. These known elements, which act as unwinding accelerators (balloon-breakers) have various geometrical forms, as is well known by those working within the field. However, in the best of cases they only lessen the phenomenon, but do not lead to an optimum result of uniformity in the unwinding tension between the start and finish of unwinding the thread form the supply cop.

Means of controlling the spooling speed, i.e. the winding speed, have also been proposed as a countermeasure to keep the thread tension at practically constant levels from the beginning to the end of the cop from which the thread is unwound, as described in U.S. Pat. No. 4,805,846.

To obtain a thread tension which is approximately constant, in the said Patent the effect of the spooling speed on the thread tension is used. Indeed, by considerably reducing the spooling speed, in the interval of time in which the thread is unwound from the bottom part of the spinning cop, the tension is kept at a more or less uniform level for the entire duration of the spooling process. Such a solution will considerably reduce the operating performance of the spoolers in that for a certain interval of time the unwinding speed is considerably reduced and therefore a smaller quantity of thread will be transferred (wound on) in one unit of time. To all practical purposes this is unusable since it results in a considerable drop in the operating performance of the spooler and consequently its productivity is penalised.

The aim of the present invention is to resolve the above-mentioned problems of the known state of the art by providing a device which ensures that the tension of the thread being supplied in the spooler is kept at an essentially constant value during unwinding of the entire spinning cop and which offers the following advantages:

it can be applied for any type of thread be it fine, medium or thick;

it can be installed on existing spoolers;

it enables the thread at high transfer speed to assume a geometrical configuration of contained energy dissipation which is highly important in the above-mentioned known state-of-the-art applications.

These and yet other advantages are achieved by the device described in the present invention capable of correcting the variation in the value of the unwinding tension in a spooler, which is designed to wind thread at high speed unwinding it from a cop below that supplies thread to the reel above being formed, the said device including:

two movable elements which act as unwinding accelerators, one fixed located above the top of the cop and the other movable which pivots between an inoperative position spaced apart form the cop and an operative position coaxial and surrounding the cop so as to place itself concentrically to the cop and in a lower position at the moment when there is a reduced minimum quantity of wound thread on the end part of the cop being gradually unwound. These elements, which act as unwinding accelerators, are both essentially quadrangular in shape and both have a side slit for introduction of the thread which occurs each time the supply cop is replaced;

a kinematic mechanism which activates the said descent by means of an angular rotation of the bottom movable element, which acts as an unwinding accelerator on the end part of unwinding the thread from the cop, the said kinematic mechanism being a pneumatic actuator, which is activated whenever there is a reduced minimum quantity of wound thread on the end part of the cop being unwound;

an element capable of detecting the end position of unwinding of the thread from the cop, i.e. to detect the reduced minimum quantity of wound thread on the end part of the cop as a result of which the said descent by means of rotation of the movable element is activated, the said detection element being a photocell, or any photoelectronic element positioned and secured at the end part of the accumulation of wound thread.

The invention shall be described in detail below on the basis of the example of embodiment schematically represented in the drawings in the attached Figures, and additional details and characteristics shall be explained, in which connection it must be well understood that any variations in reciprocal positions of the elements and the consequent simplifications which could arise therefrom must be regarded as included in the protection requested as constructional variations covered by the general concept.

In the attached drawings.

In the Figures the same elements bear the same reference numbers.

Figure 1:
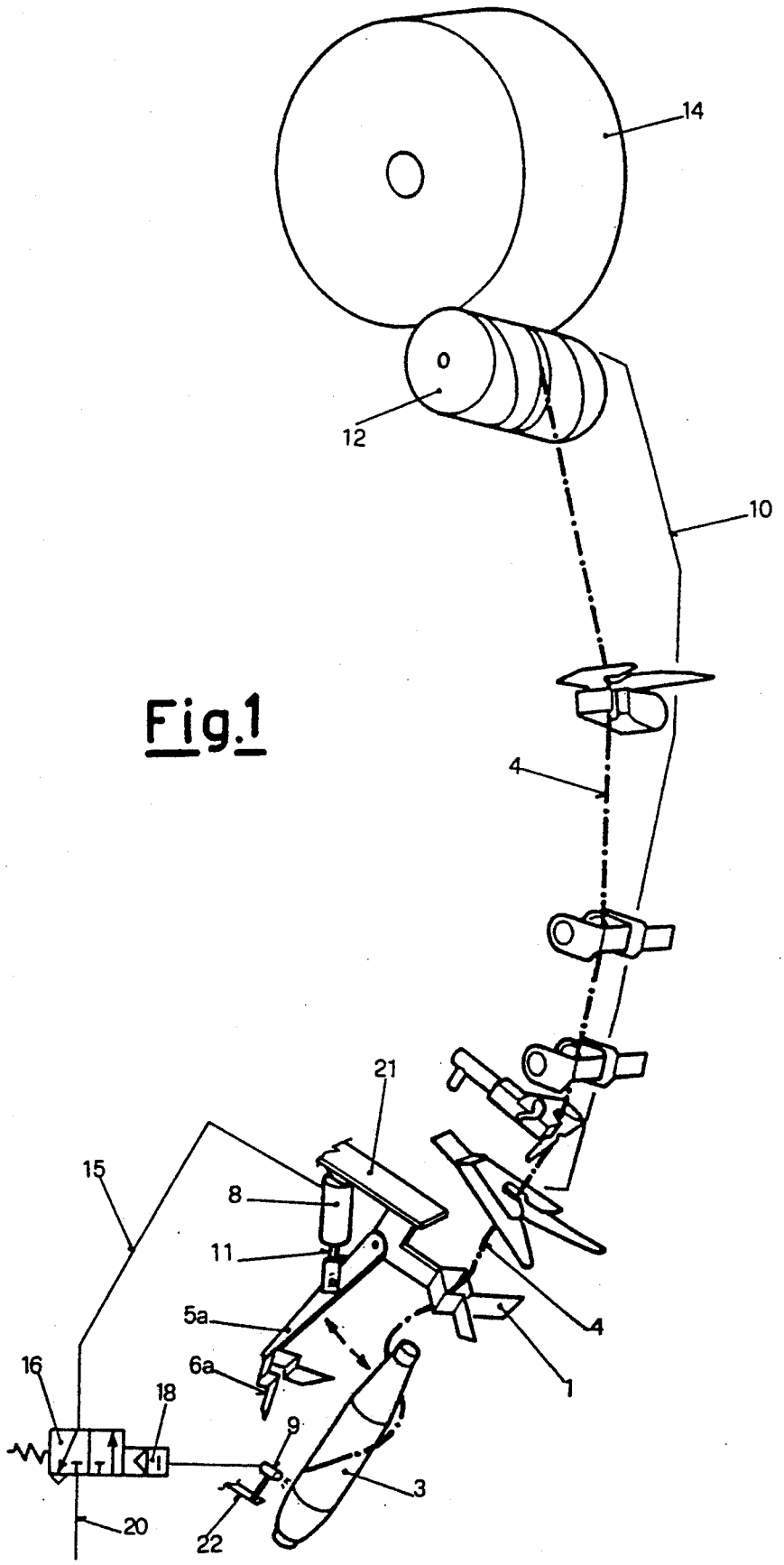
FIG. 1 is an axonometric schematic view of the device covered by the present invention, showing also the path of the thread from the cop below being unwound up to the reel above being formed and the said view shows the moment rewinding of the thread wound onto the cop supplying the spooler begins.

Furthermore, for the purpose of clarity of the invention as a whole, in the Figures the parts not necessary to understanding the invention, such as the operating and functional units along the path of the thread, the motorisation center of the thread guide roller, the reel-carrier arm, the various supporting structures and the means of supply, support and cop removal, are omitted. In the said attached Figures:

1 is the fixed element quadrangular in shape which acts as an unwinding accelerator and in addition has a side slit for the introduction of the thread which occurs at each replacement of supply cop 3. Its position is essentially concentric and perpendicular to the axis of bobbin 23 and, therefore, to cop 3 of wound thread. The said element 1 is placed with its bottom edge, at a distance from the tip of bobbin 23 essentially fluctuating at around 20 mm (in accordance with the experimental results of the proposer); 2 is the pin around which movable element **6*a* rotates angularly, the latter acting as an unwinding accelerator. The said pin 2 is anchored to support 21, the latter being fixed as a single body to the spooler frame (not illustrated); 3 is the top of wound thread made in a ring spinner; 4 is the path, shown by a dotted and dashed line, of the thread which is unwound from cop 3 below and runs upwards to wind itself in crisscross coils around the reel being formed 14. 5*a* is an arm which pivots around pin 2 and around which it rotates pushed by rod 11 of actuator 8 and the said arm 5*a* has at its end, anchored and fixed as a single body, movable element 6*a*, which acts as an unwinding accelerator; 8 is a pneumatic actuator which through rod 11 rotates the arm from position 5*a* to position 5*b*, in the direction indicated by arrow 7, in order to transfer the movable element from position 6*a* to position 6*b*; 9 is a photocell, or any photoelectronic element, capable of detecting the presence of the truncated cone portion 24 of wound thread in front when the latter is reduced to a minimum quantity in the end part of the cop. At the said minimum quantity photocell 9 on detecting such residue of wound thread (see FIG. 3), sends, through wire 19, an electrical signal which activates solenoid valve 18, the latter will operate distributor 16 designed to control the direction of the flow of air under pressure so as to deliver, through pipes 20 and 15, the air under pressure to actuator 8. The said actuator 8, via rod 11, will push arm 5*a* making it rotate around pin 2 in order to position it in position 5*b* so that the quadrangular element, fixed at the end of the said arm, moves to position 6*b* shown in FIG. 3; 12 is the supply cylinder which rotates reel 14 and, imparting an alternating back-and-forth movement, guides the thread onto the said reel 14; 10 is the schematic side outline of the structure of a spooler; 14 is the reel which is a package of thread with a truncated cone shape, or a cylindrical shape, and the said package is produced by a spooler and intended for subsequent working stages (dyeing, warping, weaving, etc.); 22 is the supporting and anchoring plate of fixed photocell 9; 23 is the thread winding bobbin, i.e. the support for the thread wound in the copping operation by a ring spinner to form a cop of yarn 3; 24 is the cone of wound thread and its truncated cone shape derives from the known method of winding the yarn onto bobbin 23** on the spindle of a ring spinner.

The operation of the device for correcting the variation in the value of the unwinding tension of thread in a spooler, illustrated by the attached drawings, can be easily understood by those working within the field.

A cop 3 full of wound thread is placed on the cop-holder post (not shown) in the supply position. Its thread 4, using known means and devices, is brought to wind itself onto the reel being formed 14 and rewinding of the thread begins, i.e. the transfer of thread 4 from co 3 below to reel 14 above.

Figures 2, 3:
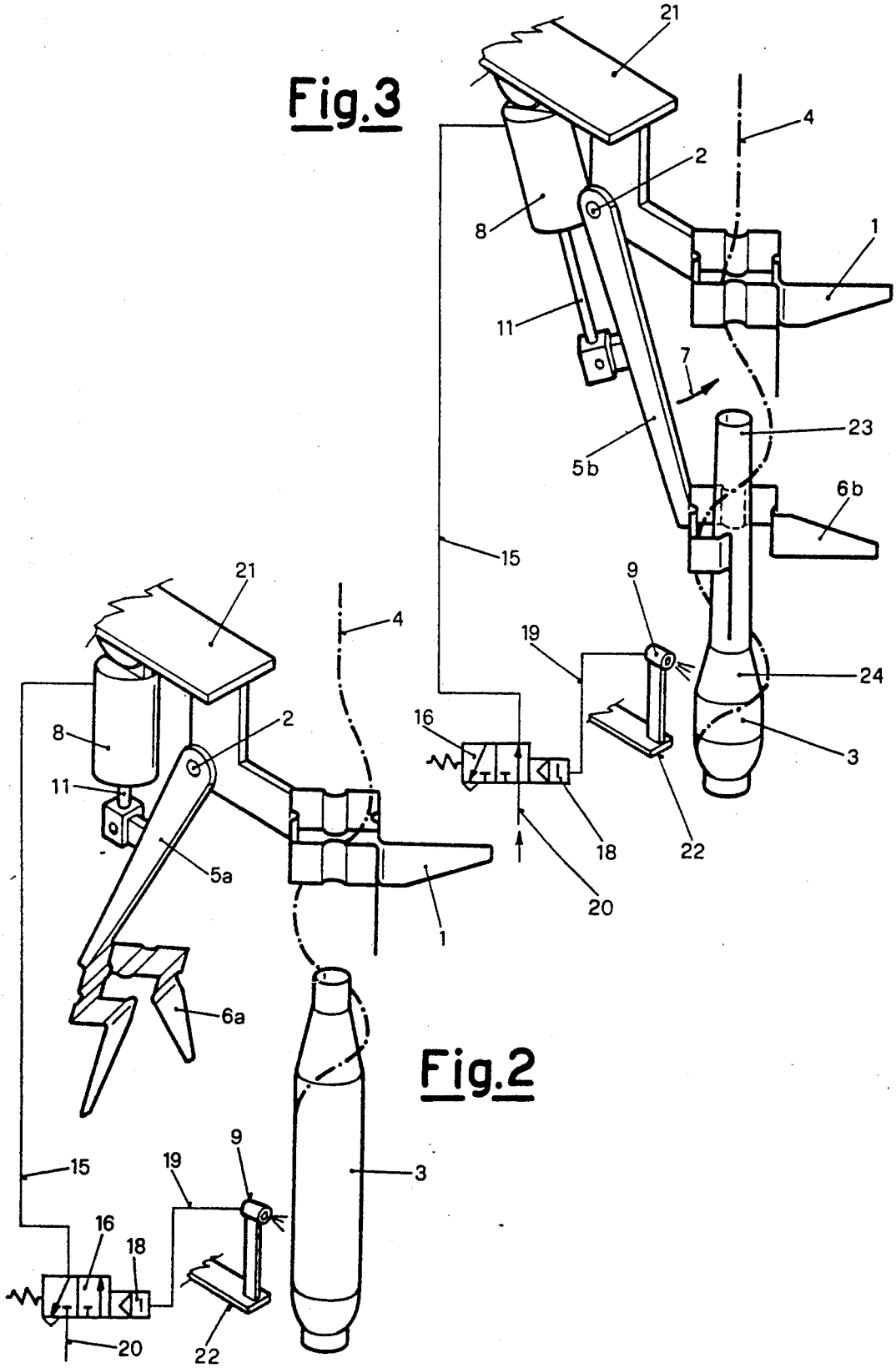
FIG. 2 is an axonometric schematic view of the device covered by the present invention at the moment when the cop is full of wound thread and is therefore the moment when unwinding of the thread to transfer it to the reel above begins.
FIG. 3 is an axonometric schematic view of the device covered by the present invention at the moment when the cop has on its end part a limited accumulation of wound thread and is therefore the moment just before unwinding of the thread from the cop to transfer it to the reel above ends.

The device covered by the present invention is positioned as shown in FIG. 2. Photocell 9 does not detect in front the presence of the truncated cone shape 24 of wound thread and quadrangular element 1 is positioned at a precise distance from the top of bobbin 23. Thread 4, drawn upwards by supplier cylinder 12, on unwinding from co 3, causes a gradual and continuous lowering of cone 24. This lowering will at a certain moment lead to truncated cone 24 being positioned in front of photocell 9.

At the said moment photocell 9 will generate an electrical output signal which, through wire 19, will activate solenoid valve 18, which will operate distributor 16 so that the flow of compressed air, from pipe 20, is emitted into pipe 15 to operate actuator 8. The said actuator 8, via rod 11, will rotate arm 5*a* to position 5*b* placing quadrangular element 6*a* in position 6*b*, as illustrated in FIG. 3.

The moveable element which functions as the balloon breaker is fixed to an arm which is pivotable between an inoperative position (5A) spaced apart from the cop and an operative position (5B) coaxial and surrounding the cop and spaced apart from the first (fixed) balloon breaker (1).

The second balloon breaker moves into the operative position when a fixed sensor 9, positioned in the proximity of the lower end of the cop 3, senses that the upper conical portion 24 of the cop 3 has reached a pre-established minimum quantity of yarn wound on the tube 23. When this condition is detected, the second balloon breaker is pivoted to the operative position (5*b*) concentric to the tube 23, above the residual yarn portion wound on the tube 23 but below the fixed balloon breaker 1. Thus, unwinding conditions are established which are substantially equivalent to those occurring at the beginning of the unwinding process.

Advantageously, the distance between the first (fixed) balloon breaker 1 and the cone portion 24 at the beginning of the unwinding process is substantially equal to the distance between the second balloon breaker in the operative position 6*b* and the cone portion 24 at the end of the unwinding process. This is not strictly necessary, but optimizes the unwinding process.

The second balloon breaker has an aperture in the peripheral wall sufficiently large and so positioned to allow the breaker to override and surround the tube 23. This enables it to pivot into its concentric operative position as shown in FIG. 3.

Fixed quadrangular element 1 is placed at a distance of experimental value form the initial rewinding point of thread 4 from cop 3 to give a certain tension value at the start of unwinding.

Incidentally, the rewinding point of thread 4 from cop 3, i.e. the point at which thread 4 on winding becomes detatched and separates from cop 3, is localised exclusively in the restricted truncated cone band 24, as is well-known by those working within the field. The said distance between quadrangular element 1 and the rewinding point below at the start of unwinding thread 4 from co 3 is approximately equal to the distance between element 6*b* and the rewinding point below at the end of unwinding thread 4 from cop 3. This results in a uniform constant value of the tension of thread 4 from the beginning to the end of cop 3, from which the thread is unwound to be transferred onto reel 14 being formed above. In this way the tension of thread 4 is maintained at an essentially uniform level for the entire duration of the spooling process due to the operating presence of the device in question, which will consequently prevent most of the breakages of thread 4 during its transfer from cops 3 to reel 14 being formed.

All this enables extremely striking comparisons to be made particularly in the case of high-speed spoolers in which the speed of transfer of thread 4 from cop 3 to reel 14 is in the order of 2000 m/min and above.

Since the tension of the thread remains more or less uniform it is possible, as frequent accidental breakages do not occur, to obtain great improvements in the operating performance of spoolers and consequently in their productivity.

It is purely by way of example that a pneumatic actuator has been used since similar kinematic movement mechanisms may be used capable of positioning, as shown in FIG. 3, quadrangular-shaped element 6*a*, which acts as a lower unwinding accelerator in the end part of unwinding the thread, and various modifications in detail may also be made to the form of arm 5*a* and its method of fixing both to rod 11 and to movable quadrangular element 6*a* without going beyond the scope of the invention.

We claim:

1. In a winding machine having a source for supplying thread and a reel for receiving the thread as the thread is fed in a path from the source, wherein the source has an upper portion, a lower portion, and a longitudinal axis, a device for regulating thread tension, comprising:

a) a fixed element fixed proximate to the upper portion of the source and surrounding the longitudinal axis of the source;

b) detecting means fixed proximate to the lower portion of the source for detecting a predetermined position of the thread as it unwinds and reaches the lower portion of the source, and sending a signal representative thereof;

c) a moveable element operably attached to the winding machine, wherein said moveable element is adapted for moving from a first position spaced apart from the source to a second position coaxial and surrounding the longitudinal axis of the source; and d) a drive mechanism adapted for receiving said signal from said detecting means and activating said movement of said moveable element from said first position to said second position so that when the thread unwinds and reaches said predetermined position on the source, said detecting means detects said predetermined position of the thread on the source and said drive mechanism responds to said signal from said detecting means and moves said moveable element from said first position to said second position to surround the longitudinal axis of the source and thereby regulate thread tension.

2. The device of claim 1, wherein said fixed element and said moveable element each comprise a member having four arms substantially forming a quadrilateral with a slit therein so that the thread can be introduced through said slit and can be substantially surrounded by said quadrilateral.

3. The device of claim 2, wherein said slit of said quadrilateral of said moveable element comprises an extended aperture for allowing the positioning of said moveable element into said second position.

4. The device of claim 1, wherein said drive mechanism comprises a pneumatic actuator for activating said movement of said moveable element from said first position to said second position.

5. The device of claim 5, wherein said detecting means comprises an optically sensitive means for detecting said predetermined position of the thread on the source.

6. The device of claim 1, wherein said second position of said moveable element relative to said predetermined position of the thread on the source is substantially equivalent to the position of said fixed element relative to the thread on the source at the beginning of supplying the thread to the reel.

* * * * *